US005159984A

United States Patent [19]

Hattori

[11] Patent Number: 5,159,984

[45] Date of Patent: Nov. 3, 1992

[54] SPRINKLER HEAD

[76] Inventor: Takamasa Hattori, 218-315 Ogaito Oaza Kumatori-cho, Sennan-gun, Osaka-fu, Japan

[21] Appl. No.: 695,561

[22] Filed: May 3, 1991

[30] Foreign Application Priority Data

Jun. 22, 1990 [JP] Japan ..... 2-66651[U]

[51] Int. Cl.[5] ..... A62C 37/11

[52] U.S. Cl. ..... 169/38; 169/37; 169/39

[58] Field of Search ..... 169/38, 37, 39, 40, 169/41, 90

[56] References Cited

U.S. PATENT DOCUMENTS

| | | | |
|---|---|---|---|
| 4,618,002 | 10/1986 | Mears | 169/37 |
| 4,766,961 | 8/1988 | Macie | 169/37 X |
| 4,938,292 | 7/1990 | Johnson | 169/37 X |
| 5,036,923 | 8/1991 | Shea, Sr. | 169/37 |

*Primary Examiner*—Margaret A. Focarino
*Assistant Examiner*—James M. Kannofsky
*Attorney, Agent, or Firm*—Koda and Androlia

[57] ABSTRACT

A sprinkler head comprises an elastic retainer which is mounted between a couple of clamps and can absorb and reduce a tightening power which is added to a heat sensitive part by the insertion of a screw. Water can be sprayed according to circumstances due to an improvement in the sensitivity of the heat sensitive part.

5 Claims, 5 Drawing Sheets

SPRINKLER HEAD

BACKGROUND OF THE INVENTION

1. Field of the Invention

This invention relates to a sprinkler head, and more particularly to what is called a frame type sprinkler head for spraying water to extinguish a fire when a fire and the like break out.

2. Description of the Prior Art

FIG. 6 shows an example of the conventional sprinkler head which uses what is called a glass valve as a heat sensitive part.

In this conventional sprinkler head, the top of a glass valve 21 is made to fit into an exit 5 of a sprinkler head body 1 and the bottom of the glass valve 21 is pressed and fixed in the sprinkler head body 1 by screwing an impress screw 24 through a valve seat 25.

When a fire and the like break out, a liquid 23 expands with heat and the glass valve 21 is broken. Hence, the exit 5 is released and water is sprayed from the exit 5.

However, in the above conventional sprinkler head, since the glass valve 21 is made to fit directly into the exit of the sprinkler head body 1 as a plug 4 and the sprinkler head is maintained to be blocked by pressuring the glass valve 21 by tightening the impress screw 24, the glass valve needs to be relatively strengthened by making it thick. However, if the sprinkler head 21 is formed in such a way, since the heat sensitivity of the heat sensitive part 21 is reduced remarkably, the operation time is delayed and water cannot be sprayed properly when a fire and the like break out.

SUMMARY OF THE INVENTION

The object of the invention is to make the heat sensitivity of the heat sensitive part improve and to enable the sprinkler to spray water depending on the situation.

A sprinkler head has the exit 5 of the sprinkler head body 1 blocked by a pressuring heat sensitive part 21, which part is broken by the heat expansion of the liquid 23 sealed in the inside of the sprinkler head by screwing a screw 22;

A couple of vertical clamps 12 and 13 are set below the plug 4. To block the exit 5 by the plug 4, an elastic retainer 11 is mounted between flanges **12*b* and 13*b* of clamps 12 and 13. The retainer 11 is pressured by clamps 12 and 13 against the side of the sprinkler head body 1 when the screw 22 is screwed. Then the retainer 11 can be linked and held between an inboard concave 16 and flanges 12*b* and 13*b*, said retainer 11 is set on the concave 16 of a frame 3 of the sprinkler head body 1**.

Therefore, in the above described sprinkler head, when the screw 22 is screwed, the retainer 11 is pressured and extended by the flange **13*b* through the heat sensitive part 21 and the lower clamp 13. Consequently, the retainer 11 is linked and held between the inboard concave 16 and flanges 12*b* and 13*b* and mounted on the frame 3 of the sprinkler head body 1. Then the exit 5 of the sprinkler head body 1 is blocked by the plug 4**.

However, when the screw 22 is screwed, the lower clamp 13 is pressured upwardly through the heat sensitive part 21 as described above. Since the elastic retainer 11 is mounted between flanges **12*b* and 13*b* of clamps 12 and 13, the tightening power of the screw 22 is absorbed and reduced by the extension of the retainer 11. As a result, the direct tightening power of the screw 22 is not added to the heat sensitive part 21. Hence, the thickness of the heat sensitive part 21** can be reduced and the sensitivity of the heat sensitive part can be improved.

Also, when a fire breaks out, the liquid 23 in the heat sensitive part 21 is expanded by heat and the heat sensitive part 21 is broken. Since the lower clamp 13 is lowered and the retainer 11 is shrunk inboard, the connection condition of the upper clamp 12 with the inboard concave 16 of the frame 3 is released. Then since the upper clamp 12 is lowered and the plug 4 is released and removed from the exit 5 of the sprinkler head body 1, water can be sprayed from the exit 5.

BRIEF DESCRIPTION OF THE DRAWINGS

The manner in which the foregoing and other objects of this invention are accomplished will become apparent from the accompanying specification and claims considered together with the drawings, wherein:

In the drawings, like references numerals represent like or corresponding parts.

DETAILED DESCRIPTION OF PREFERRED EMBODIMENT

A preferred embodiment of this invention is described below with reference to the accompanying Figures.

Figure 1:
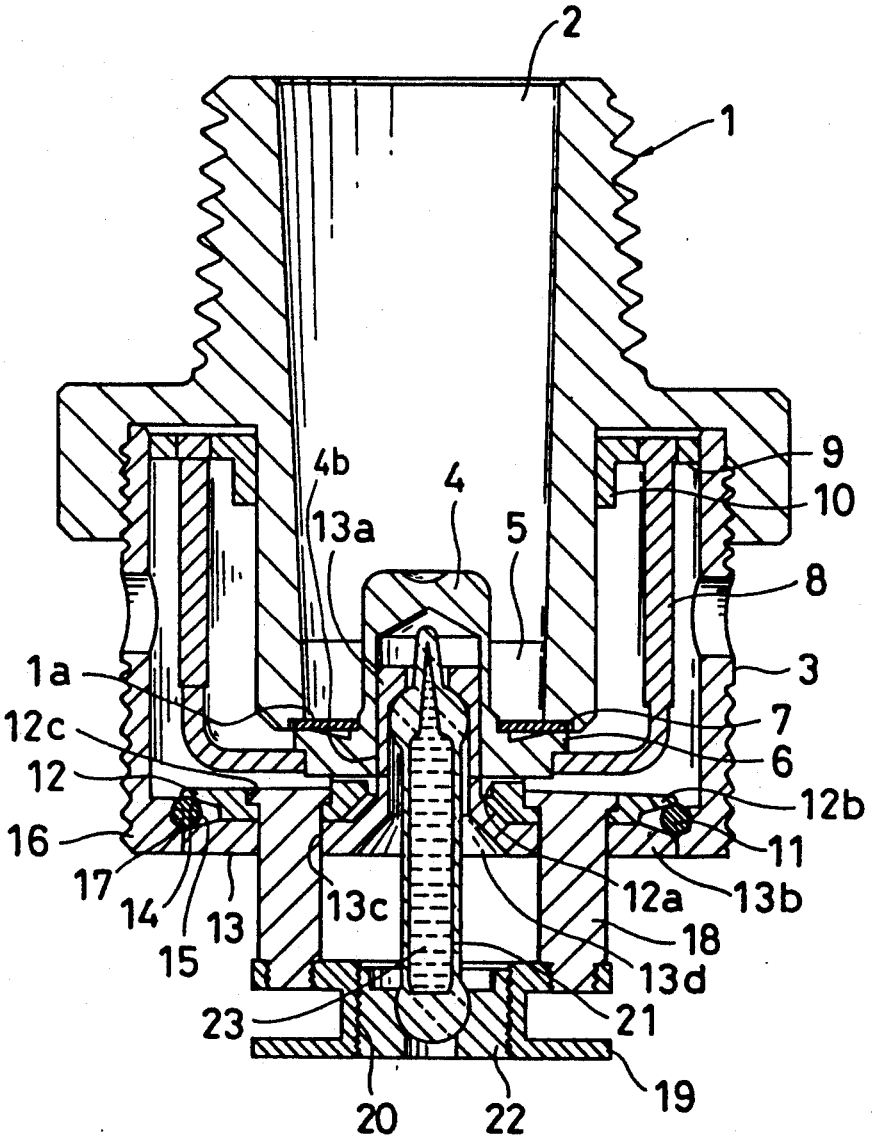
FIG. 1 is a sectional view of a sprinkler head according to an example of this invention.
Figure 2:
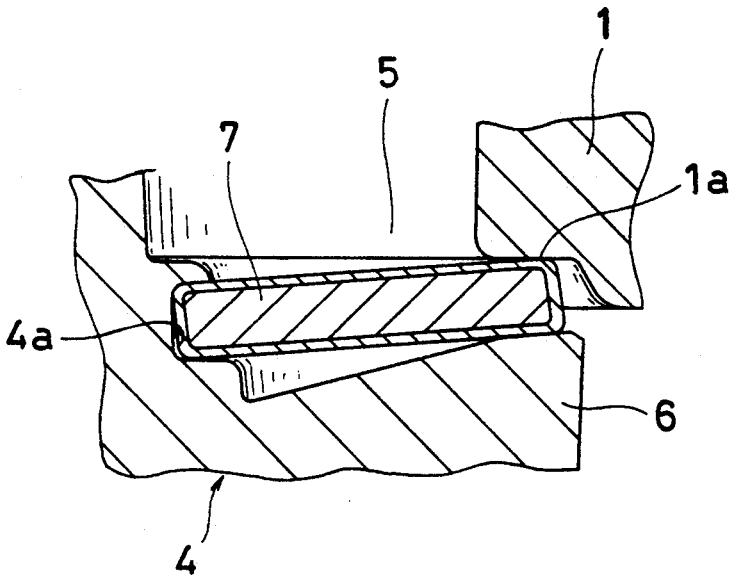
FIG. 2. is an enlarged detail view showing a spring which is under tension.

In FIG. 1, a sprinkler head body 1 forms a water pass 2. A rough cylindrical frame is screwed in a lower peripheral edge of the body 1 with screws. A plug 4 seals an exit 5 which is formed at a,.lower section of the sprinkler head 1. The plug 4 has a hollow shape and has a flange 6 at a peripheral edge of a lower section thereof. A spring 7 is made of a plate screw coated with fluoroplastic and is mounted between a bottom or lower section **1*a* of the body 1 and an upper surface of the flange 6 of the plug 4 under a compression condition by having a certain pressure applied to it. As seen in FIG. 2, an internal circumference face of the spring 7 is fitted into a hollow groove 4*a* which is formed on an external circumference face of the plug 4. More than one curved deflector 8 is connected to the external circumference edge of the plug 4. A slidable guide 10 is connected to a guide ring 9 which is mounted on the sprinkler head body 1 downwardly. The deflectors 8 function as a guide when the plug 4** falls.

Figure 3:
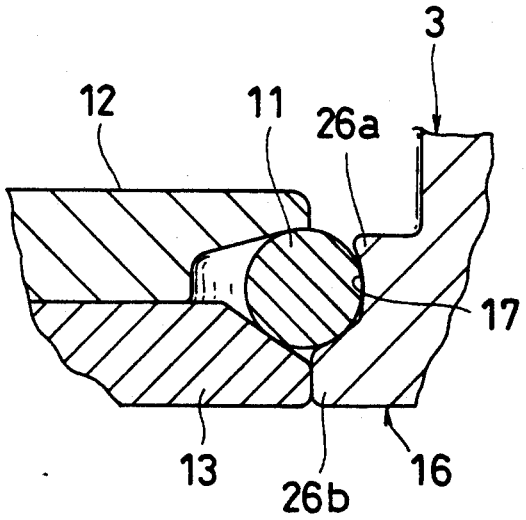
FIG. 3. is an enlarged detailed sectional view showing a retainer which is connected and maintained between an inboard concave and both clamps.
Figure 4:
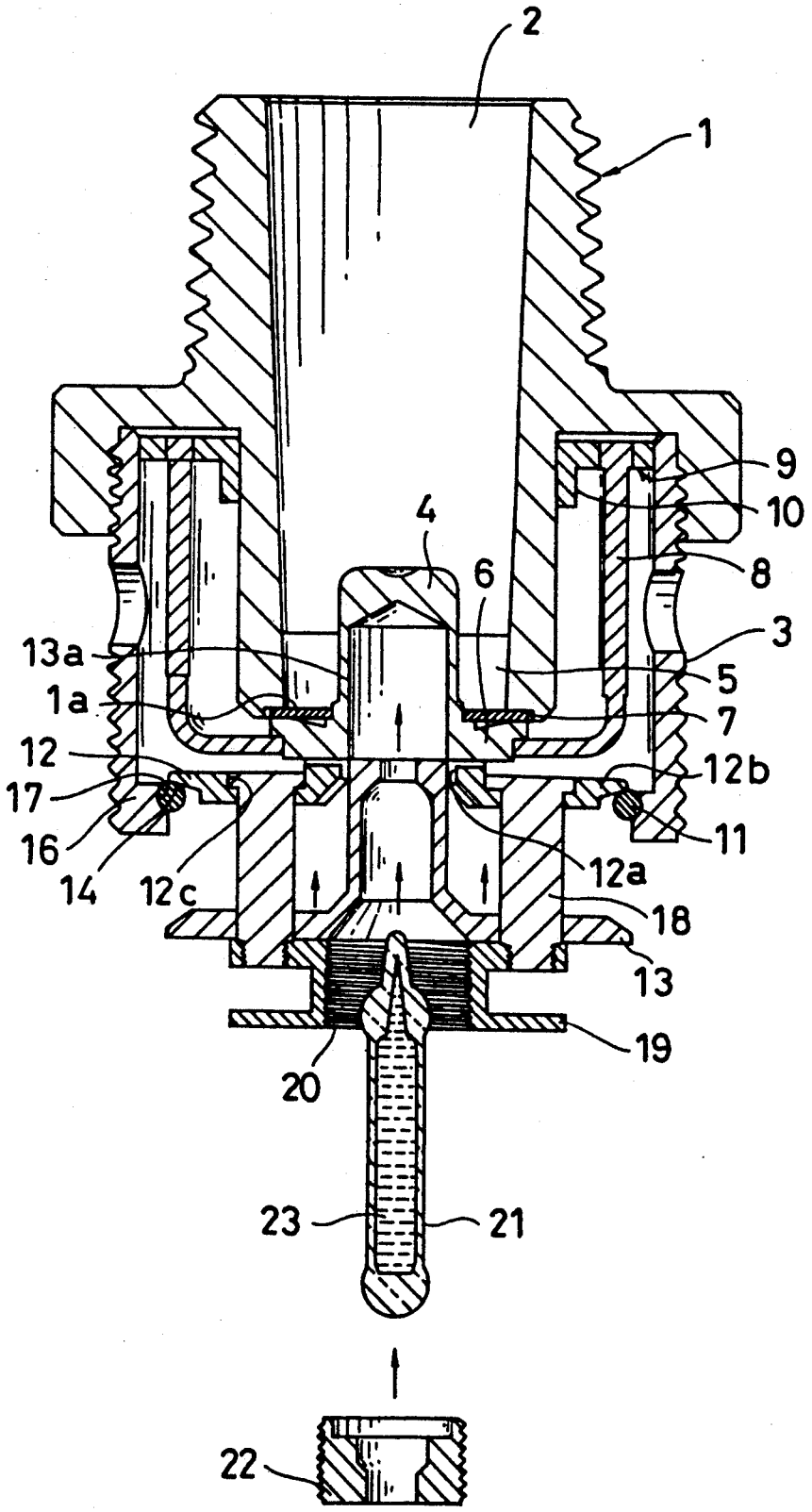
FIG. 4 is a sectional view showing an example of construction of the sprinkler head.

A retainer 11 is partially shaped like a cut ring and its diameter can be deformed elastically. A couple of clamps 12 and 13 are used to mount and hold the retainer 11. A hole **12*a* is punched in the approximate center of the top surface of the upper clamp 12 and a projection 13*a* having a hole 13*d* is formed at the approximate center of the lower clamp 13. The projection 13*a* is slidably fitted into the plug 4 through the hole 12*a* of the upper clamp 12. Tapers 14 and 15 are formed around the external peripheral edges of the flanges 12*b* and 13*b* of clamps 12 and 13 respectively. Each space between the tapers 14 and 15 narrows inboard in order that the retainer 11 can be held under a tension condition as shown in FIG. 3. An inboard concave 16 is formed on the internal peripheral edge of the frame 3. A wall 17, which can be fitted and connected to the retainer 11 supported by clamps 12 and 13, is formed as seen in FIG. 3. Retained convexes 26***a* and 26*b* are vertically mounted on the wall 17. The inside diameter of the inboard concave 16 is larger than the respective outside diameters of the clamps 12 and 13.

A connecter railing 18 is elastically fitted into the holes 12*c* and 13*c* which are punched in the flanges 12*b* and 13*b* of the clamps 12 and 13. A hold plate 19, which has a female screw 20 formed on the internal face thereof, is screwed at the approximate center of the top of the railing 18. A heat sensitive part 21 is called a glass valve. The top of the heat sensitive part 21 is fitted into the the lower clamp 13 and the bottom of the heat sensitive part 21 is pressured and held by a rock screw 22 screwed in the female screw 20 of the hold plate 19. Alcohol 23 is sealed in the glass body.

The application of this invention will now be described.

First, according to the following methods, the sprinkler head can be assembled easily. Clamps 12 and 13 are made to move up and the retainer 11 is held between the taper faces 14 and 15 of the respective clamps 12 and 13. Then the heat sensitive part 21 is inserted into the hole in the bottom of the hold plate 19 and the top of the heat sensitive part 21 is fitted and inserted into clamps 12 and 13. The rock screw 22 is screwed into the female screw 20 of the hold plate 19.

The lower clamp 13 is pressured upwardly by means of the heat sensitive part 21 while the rock screw is being tightened. However, since the elastic and transformable retainer 11 is mounted between the tapers 14 and 15, the compressive force of the rock screw 22 is not added to the heat sensitive part 21 directly and the power is absorbed and reduced by the extension movement of the retainer 11 along the tapers 14 and 15 and the retainer 11 itself. Accordingly, since the strength of the glass which forms the heat sensitive part 21 needs not to be strengthened and the thickness of the heat sensitive part can be reduced, the sensitivity of the heat sensitive part 21 to temperature can be improved.

On the other hand, the spring 7 is pressured at the flange 6 of the plug 4 upwardly by being screwed by the rock screw 22 and is held between the exit 5 and flange 6 of the sprinkler head 1 under a compression condition at a certain pressure. When the rock screw 22 is tightened into the female screw 20 so that approximately 60% pressure of the resistive power of the spring 7 is applied, if this condition is maintained for a long time, the elasticity of the spring 7 will not be reduced.

Next, when a fire and the like break out, the expansion of alcohol 23 makes the glass of the heat sensitive part 21 break and the lower clamp 13 lower. Then the retainer 11 is shrunk and the connection condition with the wall 17 of the inboard concave 16 of the frame 3 is released. In consequence, clamps 12 and 13, and the hold plate 19 and the like fall to the lower part of the sprinkler head body 1. The plug 4 is released and lowered from the exit 5 by the elasticity of the spring 7 and the exit 5 is opened.

Since the plug 4 is equipped with the guide ring 9 having the guide 10 through the deflector 8, the guide 10 is guided by it rubbing against the external circumference face of the sprinkler head 1. Accordingly, the plug 4 descends smoothly without vibration and the guide ring 9 is retained in the inboard concave 16. Thus the plug 4 stops descending.

Figure 5:
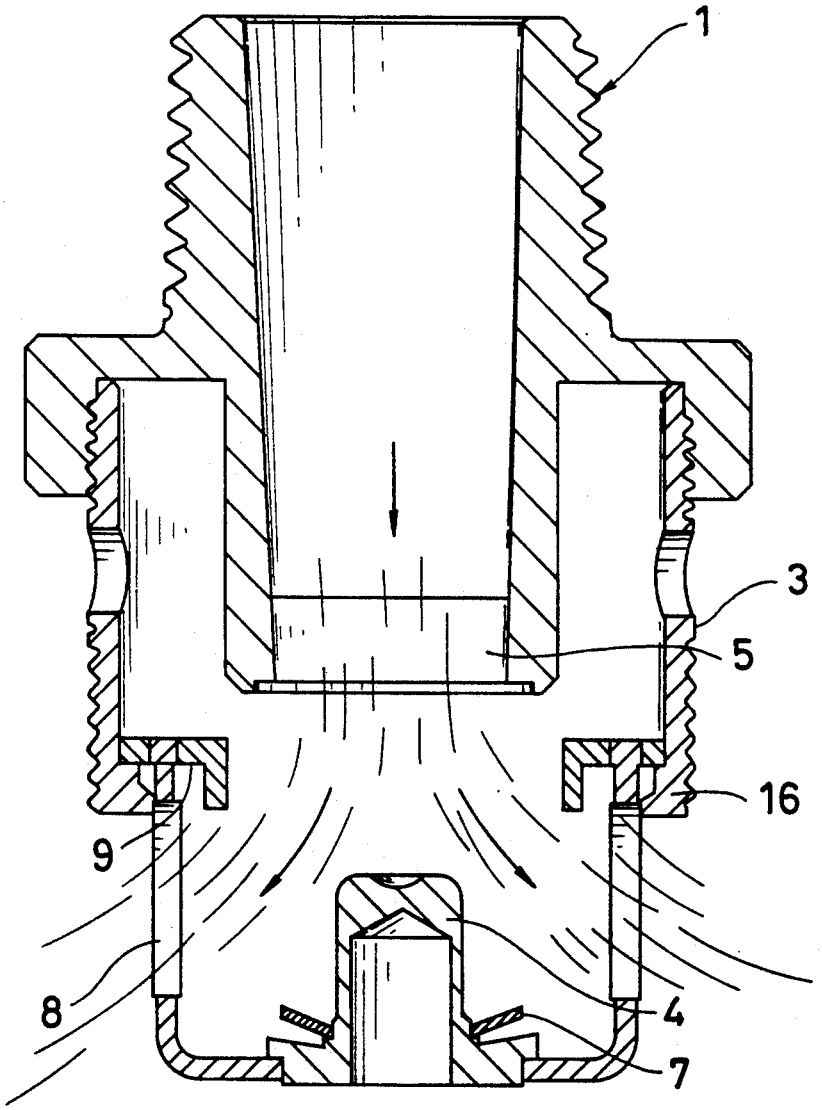
FIG. 5 is a sectional view showing water being sprayed.
Figure 6:
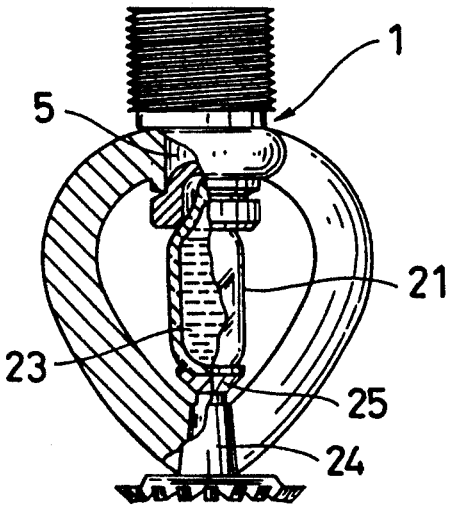
FIG. 6 PRIOR ART
FIG. 6 is a partially sectional front view showing an example of the conventional sprinkler head.

Further, after water flowing from the exit 5 bumps against the top of the plug 4, water is dispersed in every direction and is sprayed so as to radiate as shown in FIG. 5.

Note that the concrete thickness of the glass which is formed of the heat sensitive part is not limited and this thickness can be changed depending on the elasticity and the like of the retainer 11 as occasion demands.

The shape of elastic retainer 11 is not limited to that of a part cut ring and it can also have a complete ring shape.

Furthermore, in the above example of the embodiment of this invention, the spring comprises the plate screw coated with fluoroplastic but the concrete composition is not limited to the same.

It is further understood by those skilled in the art that various changes and modifications may be made in a sprinkler head body 1, a frame 3, a plug 4, clamps 12 and 13, and a rock screw 22 and the like without departing from the spirit and scope thereof.

EFFECT OF THIS INVENTION

As described above, since the elastic retainer is mounted between clamps, the tightening power of a screw is absorbed and reduced by the extension of the retainer.

Accordingly, the tightening power of the screw is not added to the heat sensitive part. In the conventional sprinkler head, the heat sensitive part is directly pressured by the screw and the heat sensitive part is fitted into the exit of the sprinkler head as a plug.

As the result the thickness of the glass, which the heat sensitive part is formed of, can be reduced and the heat sensitivity of the heat sensitive part can be improved.

What is claimed is:

1. A sprinkler head whose exit is blocked by pressuring a heat sensitive part 21, which part is broken by a heat expansion of a liquid 23, sealed in the inside of the sprinkler head by means of an insertion of a screw 22; comprising:

a couple of vertical clamps (12 and 13) set below a plug 4, an elastic retainer 11 mounted between flanges (12*b* and 13*b*) of the clamps (12 and 13) to block an exit 5 with the plug 4; and the retainer 11 pressured by the clamp 13 at the side of a sprinkler head body 1 when the screw 22 is screwed, said retainer 11 is linked and held between an inboard concave 16 and the flanges (12*b* and 13*b*), said retainer 11 is set on said concave 16 of a frame 3 said sprinkler head body 1.

2. A sprinkler head as claimed in claim 1. wherein a spring 7 is mounted between a bottom la of said sprinkler head body 1 and the plug 4 under a compression condition.

3. A sprinkler head as claimed in claim 2, wherein a surface of said spring 7 is coated with fluoroplastic.

4. A sprinkler head as claimed in claim 2, wherein said spring 7 is made of a plate spring.

5. A sprinkler head whose exit is blocked by pressuring a heat sensitive part 21, which part is broken by a heat expansion of a liquid 23, sealed in the inside of the sprinkler head by means of an insertion of a screw 22; comprising:

a couple of vertical clamps (12 and 13) set below a plug 4, an elastic retainer 11 mounted between flanges (12*b* and 13*b*) of the clamps (12 and 13) to block the exit 5 with the plug 4;

a hollow projection 13*a* mounted on a lower clamp 13 of the clamps (12 and 13) so a part of said heat sensitive part 21 can be inserted, said projection 13*a* being slidably fitted into a hole 4*b* of said plug 4 through a hold 12*a* formed in an upper clamp 12 of the clamps (12 and 13), a hold plate 19, which has a female screw 20 formed on an internal face thereof, mounted on a top of a connector railing 18, a screw 22 is screwed into the female screw 20 of the hold plate 19, an other part of the heat sensitive part 21 being formed so it can be pressured; and the retainer 11 is pressured by the clamps (12 and 13) against a side of a sprinkler head body 1 when the screw 22 is screwed, said retainer 11 being linked and held between an inboard concave 16 and the flanges (12*b* and 13*b*), said retainer 11 is set on said concave 16 of a frame 3 of said sprinkler head body 1.

* * * * *